United States Patent [19]

Wiegand

[11] 4,153,488

[45] May 8, 1979

[54] MANUFACTURE OF FIBROUS WEB STRUCTURES

[75] Inventor: Donald E. Wiegand, Minneapolis, Minn.

[73] Assignee: Conwed Corporation, St. Paul, Minn.

[21] Appl. No.: 857,806

[22] Filed: Dec. 5, 1977

Related U.S. Application Data

[63] Continuation of Ser. No. 640,162, Dec. 12, 1975, abandoned, which is a continuation-in-part of Ser. No. 407,934, Oct. 19, 1973, Pat. No. 3,939,532, which is a continuation-in-part of Ser. No. 253,098, May 15, 1972, abandoned, which is a continuation-in-part of Ser. No. 46,594, Jun. 16, 1970, abandoned.

[51] Int. Cl.[2] ..... B29J 5/00

[52] U.S. Cl. ..... 156/62.2; 19/304; 156/181; 156/285; 156/296; 428/280

[58] Field of Search ..... 428/280; 19/156.3; 156/62.2, 285, 296, 181

[56] References Cited

U.S. PATENT DOCUMENTS 3,071,822 1/1963 Meiler ..... 19/156.3

*Primary Examiner*—James J. Bell

*Attorney, Agent, or Firm*—Eyre, Mann, Lucas & Just

[57] ABSTRACT

Fibrous web structures in which the individual fibers are uniformly felted in random orientation are produced by projecting a stream of solids suspended in air toward a moving porous collection surface. The fibers are maintained in a controlled condition uniformly dispersed in air during transit from the nozzle to the porous collecting surface and before the stream of air has spread to the point of disrupting the uniform fiber dispersion, the fibers are felted and collected on the porous support while air is continuously passed through the support to insure no gravity free fall of fibers. Liquid or dry adhesive binders may be incorporated into the structure at any convenient stage of the process but preferably before the web structure is formed on the moving support.

12 Claims, 6 Drawing Figures

MANUFACTURE OF FIBROUS WEB STRUCTURES

This application is a continuation of my copending application Ser. No. 640,162 filed Dec. 12, 1975 and now abandoned which is in turn a continuation-in-part of application Ser. No. 407,934 filed Oct. 19, 1973 which issued as U.S. Pat. No. 3,939,532 which was in turn a continuation-in-part of application Ser. No. 253,098 filed May 15, 1972 and now abandoned which in turn is a continuation-in-part of application Ser. No. 46,594 filed June 16, 1970 and now abandoned.

BACKGROUND OF THE INVENTION

The present invention relates to the manufacture of felted fibrous webs or mats formed by projecting a stream of fibers toward a moving porous support on which the fibers are interlaced into a web-like structure. Natural and synthetic fibers such as cotton, rayon, kapak, wool and wood and other textile and paper fibers are employed in forming the fibrous structure although small quantities of mineral fibers and other additives may be mixed in with the aforementioned fibers which are hereinafter called cellulosic type fibers. If desired, binders such as starch, synthetic resins and other known adhesives may be used to strengthen the structure of the web. The selected binder in liquid or dry state may be mixed with the fibers at any convenient stage in the process or the binder may be applied to the web-like structure after it is formed. The binder is preferably added before the fiber is collected on the porous support. The resin binders such as the phenolics, latices, urea-formaldehyde, melamine-formaldehyde and epoxy resins are usually cured by application of heat to set the resin. Various processes are available for forming the above described felted fibrous mats. One typical example is described in the Duval, U.S. Pat. No. 2,646,381.

A major drawback to the known processes is that the fibers are not uniformly felted in the desired random orientation and there are clots or entanglements of fibers interspersed with thin spots throughout the structure of the web. As a result, the product does not have the desired strength, loft, stretch, drape, and softness required in many commercial applications especially in those cases where only a very thin web can be employed.

SUMMARY OF THE INVENTION

It has now been discovered that the fibers can be uniformly felted in a desired random orientation without the clots, entanglements and thin spots of the prior art structures by maintaining certain specified controls over the air-borne fiber stream during transit from the nozzle to the collecting support. During transit from the nozzle to the collecting support, there are many interrelated variable parameters which influence the characteristics of the air-borne fiber stream and the way in which the fibers are felted on the support. These interrelated variable parameters involve such factors as the physical characteristics of the individual fibers, the geometry of the nozzle opening, the velocity at which the stream is projected from the nozzle, the ratio of fiber to air in the stream, the distance traveled in transit from the nozzle to the collecting support and the impact velocity of the stream on the collecting support.

In accordance with the present invention, at least about fifty percent of the fibers and, for best results, more than sixty-five to seventy-five percent of the fibers in the air stream have a length of about 0.25 inch or less. The velocity of the air-fiber stream projected from the nozzle is maintained within a range of about 2,000 to 10,000 linear feet per minute (LFM) and preferably between about 4,000 LFM and 6,000 LFM. The distance traveled in transit from the nozzle to the collecting support is not over about ten feet and preferably between about 4 to 6 feet. Suction is employed for laying the fibers down on the collecting support.

Control of the length of the individual fibers, velocity of the air stream, and distance of travel are important to establish an air-fiber stream that can be controlled in transit to achieve the desired uniformity and random orientation of the individual fibers in the web. Long fibers require a greater amount of air for proper separation and suspension of the individual fibers in the air stream. As the amount of air increases, without an accompanying increase in the fiber-air stream velocity, the time required for forming a web of given thickness will increase and control of the air-fiber stream in transit becomes more difficult. The distance to the collecting surface should, in general, be as short as is practical for a given air-fiber stream. Another advantage of a short distance of travel from the projecting nozzle to the collecting surface is that a very compact felting unit can be constructed.

It is possible to control an air-fiber stream over relatively short distances while the stream maintains definite flow characteristics which will gradually disappear as the distance from the projecting nozzle increases. As the distance from the nozzle to the collecting surface increases, the air-fiber stream will spread out and then enter a highly turbulent region and shortly thereafter the stream will lose definition and enter a terminal zone where it is finally regarded as 'still air'. An air-fiber stream with the above-specified characteristics may be used to advantage to form a variety of different webs or mats and the stream can be controlled in transit from the nozzle to the collecting surface in accordance with the present invention. The use of suction enhances control of the air-fiber stream in the area of the collecting surface and it prevents the uncontrolled gravity free fall of individual fibers which tend to form clots that destroy a uniform random orientation of individual fibers in the web.

The exact location of the collecting surface relative to the distance that the air-fiber stream is in transit from the projecting nozzle depends primarily on two factors. These are the impact velocity of the air-fiber stream on the collecting surface and the velocity of the air drawn through the growing mat on the collecting surface. In the specification and claims, the term "collecting air" shall hereinafter mean the air which is passed through the porous collecting surface.

If the impact velocity of the air-fiber stream on the collecting surface is greater than the velocity of air being drawn through the growing mat, the air-fiber stream must expand rapidly along the mat surface until its velocity matches that of the collecting air. If the impact velocity is significantly greater than that of the collecting air velocity, disruption of the deposited mat may occur. Increasing the collecting air velocity will permit the use of higher impact velocities but this requires drawing a higher volume of air through the growing mat with need for increased static fan pressures and as the impact velocity increases there is a tendency to drive the fibers into the openings of the collecting surface which may cause difficulty in releasing the fiber web from the collecting surface.

Impact velocity of the air stream on the collecting surface is primarily a function of the configuration of the projecting nozzle, the distance the stream travels in transit from the nozzle to the collecting surface and the velocity of the air-fiber stream as it leaves the nozzle.

It is known that a fluid jet stream projected from a nozzle passes through four zones. The velocity of the jet stream remains substantially constant in zone 1 which extends about 4 nozzle diameters or widths from the nozzle outlet. In zone 1 there is little if any spreading out of the air stream. In zone 2, the velocity of the air stream varies inversely as the square root of the distance from the nozzle. For round or square shaped nozzles, zone 2 extends for about 8 diameters from the nozzle and for rectangularly shaped nozzles zone 2 extends to about 4 to 5 nozzle lengths from the nozzle outlet. In zone 2, the stream spreads out as it passes through the zone. Zone 3 starts at the end of zone 2 and may extend for about 25 to 100 or more diameters or equivalent diameters of equal areas. The velocity of the stream in zone 3 varies inversely with the distance from the nozzle outlet, and in this zone the stream will become fully turbulent. The final zone 4 is called a terminal zone in which the velocity decreases rapidly in a few diameters to a velocity range below fifty feet per minute which is regarded as still air.

Using standard equations, a graph (FIG. 6 in the drawings) has been prepared of velocity curves wherein the length of zone 1 and transition of the jet stream from zone 1 to zone 2 is dependent on the width of the nozzle. The length of zone 2 and the transition point from zone 2 to zone 3 is dependent on nozzle length. The distance from the nozzle outlet is plotted along the X axis and the Y axis shows the relationship of the centerline velocity of the jet stream Vx at distance X to the initial average velocity of the jet stream (Vo) at the nozzle outlet. Stated another way, the product of the Y value multiplied by the average velocity of the stream at the nozzle outlet is the actual centerline velocity of the air-fiber stream at the selected distance X from the nozzle outlet which is the maximum impact velocity of the fibers on a collecting surface located at the distance X. The standard equations and symbols used in plotting the graph appear in FIG. 6.

Referring to the graph and assuming a nozzle width of 2 inches, proceed to the right horizontally along the zone 1 line until the intersection with the zone 2 line for a 2 inch wide nozzle. The transition from zone 1 to zone 2 occurs at 0.7 feet (8.4 inches) away from the outlet of the 2 inch nozzle. Then proceed downwardly to the right along the zone 2 line until it intersects the vertical line of the desired nozzle length, say a four foot length (rectangular nozzle configuration). This intersection occurs about twenty feet away from the nozzle and this point marks the transition from zone 2 into zone 3. The zone 3 line proceeds downwardly away from the zone 2 line for a 2 inch wide nozzle four feet in length. In the case of a two inch wide nozzle which is two feet long (or for a circular nozzle of equivalent area), the transition from zone 2 into zone 3 occurs about ten feet away from the nozzle outlet. The standard equations used in plotting the zone 1, 2 and 3 lines are shown on the graph and the initial and centerline velocities used in the equations are determined in conventional manner.

In accordance with the present invention, it has been found that the fibers in the jet stream having the above specified characteristics will retain a controlled uniform random orientation in transit from the nozzle to the collecting surface for a selected nozzle configuration throughout zone 1 and into zone 2 and in some cases even into the more turbulent condition that exists in zone 3. However, there exists only a relatively narrow area along the velocity curves within which the fibers can be collected in the uniform random orientation of the present invention. This area as shown on the graph is delineated by the curve $Y = X^2/20$ and by the curve $Y = X^2/135$ which is the maximum distance for Xc. The preferred collection point lies close to the intersection of the zone 2 curve with the curve $Y = X^2/80$. When the collecting surface is located closer to the nozzle than the minimum collection distance given by the curve of $Y = X^2/20$, the fibers in the stream are under control but the impact velocity on the collecting surface is too high and the dsired uniform deposition of the individual fibers will be disrupted. Beyond the maximum collection distance of the curve $Y = X^2/135$, there will exist the relatively controlled flow of zone 2, depending on the selected nozzle configuration but the spreading of the stream in transit will become too great to maintain a uniform and direct path of fiber flow from the nozzle to the collecting surface. In the peripheral areas, the fibers increasingly slow down and leave the main stream with a swirling motion which causes clots to form due to the contact with adjacent fibers. This results in the formation of a mat with undesirable uniformity, especially when the collection point in zone 2 or zone 3 extends beyond the curve $Y = X^2/135$.

Referring again to the graph, it is again emphasized that the centerline velocity of the stream at any distance X from the nozzle outlet is expressed as a fraction of the original projected average velocity. Thus, the centerline velocity is determined by reading the value on the Y axis that corresponds to a point on the velocity curve and multiplying it by the average outlet velocity.

It will be noted from the graph that with a nozzle width of ½ inch and length of 6 inches (rectangular) and with the collection surface positioned 4 feet away from the nozzle outlet, the fibers will be collected on the surface in the beginning of the turbulent zone 3 where the impact velocity is only 20% of the nozzle outlet velocity of the stream. This collection part way into zone 3 does not seriously affect the web formation and it is sometimes desirable to provide a reduced impact of the air stream at the collecting surface. Using a ½ inch wide, 6 foot long nozzle with the collection surface positioned 4 feet away from the nozzle outlet, the impact velocity on the collecting surface would be 25% of the nozzle outlet velocity and collection takes place well within zone 2. The turbulence of zone 3 does not occur until about thirty feet away from the nozzle outlet. It will be noted that an increase in length of the ½ inch wide nozzle from 6 inches to 6 feet only increased the impact velocity by 5% for an air-fiber stream having the above-specified characteristics. However, a 4 inch wide nozzle 6 feet long would give an impact velocity of 70% of the nozzle outlet velocity on a collecting surface 4 feet away from the nozzle outlet. This 70% impact velocity can only be reduced by moving the collecting surface further away from the nozzle outlet and a distance of over thirty feet would be required to achieve a 25% impact velocity on the collecting surface. High impact velocities may be used but the collecting air velocity must also be increased as described hereinabove. The preferred location of the collecting surface close to the curve $Y = X^2/80$ represents the best position to compromise the effect of impact velocity and the amount of expansion of the fiber stream at the collecting surface.

The angle of divergence of the fiber stream is rather small throughout zone 1 especially with velocities in the range above three thousand feet per minute (FPM). In zone 2, the boundary countours tend to swirl somewhat and are more readily affected by external conditions. The angle of divergence in zone 2 is approximately twenty to forty degrees. Thus, as Xc falls to the right of the curve $Y = X^2/135$ the stream spread tends to become excessive and the stream loses its coherence and the controlled uniform flow of the fibers is lost.

Starting with a nozzle width (narrowest dimension of a rectangular nozzle) in the one inch to two inch range, the approximate width of the air-fiber stream (Sc) at the collection surface will be about 0.39 Xc. Therefore, if Xc is in the range of 4.0 to 6.0 feet, Sc will be in the range of 1.5 to 2.5 feet. This spreading of the air stream is reduced somewhat by the collecting air being drawn through the collection surface.

The values of Xc shown on the graph within the specified range are delineated by the following equations in which ho is the nozzle width in inches, Xc is the collecting distance in feet and the nozzle length (lo) in inches is equal to or greater than 12 ho 1/5.

1. The preferred value of $Xc = 5.02$ ho 1/5
2. The minimum value of $Xc = 2.88$ ho 1/5
3. The maximum value of $Xc = 6.20$ ho 1/5

The first of the above equations establishes the following preferred values for Xc which appear on the graph and in Table I for the distance between the collecting surface and nozzle outlet for various nozzle configurations. The following minimum and maximum values set forth in Table I are determined by equations 2 and 3 above.

Table I

| Nozzle Width in Inches (ho) | Nozzle Length (lo) in Inches Equal to or Greater Than | Xc in Feet Minimum | Preferred | Maximum |
|---|---|---|---|---|
| 0.5 | 10.5 | 2.5 | 4.4 | 5.4 |
| 1.0 | 12.0 | 2.9 | 5.0 | 6.2 |
| 2.0 | 13.8 | 3.3 | 5.8 | 7.1 |
| 3.0 | 15.1 | 3.6 | 6.3 | 7.7 |
| 4.0 | 15.9 | 3.8 | 6.6 | 8.2 |

Also, $Xc = 3.32$ (ho lo) 1/6 where the symbol lo is the nozzle length in inches and the other symbols are as described above.

The above equation establishes the following preferred values for Xc, under conditions expressed in Table II below:

Table II

| Nozzle Width in Inches (ho) | Nozzle Length (lo) in Inches Less Than | Preferred Xc in Feet for Various Nozzle Lengths, lo* 14" | 12" | 10" | 8" | 6" | 4" |
|---|---|---|---|---|---|---|---|
| 0.5 | 10.5 | — | — | 4.3 | 4.2 | 4.0 | 3.7 |
| 1.0 | 12.0 | — | — | 4.9 | 4.7 | 4.5 | 4.2 |
| 2.0 | 13.8 | — | 5.6 | 5.5 | 5.3 | 5.0 | 4.7 |
| 3.0 | 15.1 | 6.2 | 6.0 | 5.9 | 5.6 | 5.4 | 5.0 |
| 4.0 | 15.9 | 6.5 | 6.3 | 6.1 | 5.9 | 5.6 | 5.3 |

*Minimum values are in the range of 55% to 63% of the preferred values. An average value of about 60% can be used without significant error or Xc = 1.99(ho lo)$^{1/6}$.

*Maximum values are about 19% greater than the preferred values or Xc = 3.95 $^{1/6}$. lo) 1/6.

The maximum curve of $Y = X^2/135$ was established so that the distance of the collecting surface from the nozzle outlet would not be more than about twenty percent greater than the preferred values in the above tables and the mininum curve of $Y = X^2/20$ was established so that the distance of the collecting surface from the nozzle outlet is not less than about fifty-five percent of the preferred values in the tables. This delineates a range which the desired uniform random orientation of fibers in the mat may be achieved in accordance with the present invention to provide a web structure with physical characteristics not heretofore achieved by conventional processes which do not employ the collecting air and specified range of distance between the collecting surface and the nozzle for required control of fiber orientation in transit from the nozzle to the collecting surface. As used throughout the specification and claims, the term graph of velocity curves in zones 1, 2 and 3 for a jet stream is intended to mean the curves plotted on the graph of FIG. 6 as determined by the equations used herein.

In plotting the velocity curves it will be noted that a value of Vx/Vo of 1.2 was used for the zone 1 curve. According to standard calculation, Vx/Vo remains a constant in zone 1 and is equal to the ratio of the centerline velocity of the air stream or jet at the nozzle outlet to the average velocity of the stream at the nozzle opening. This ratio ranges from 1.0 for well rounded entrance nozzle to about 1.2 for straight pipe discharge. The value of 1.2 was employed as a practical compromise value for round, square and rectangularly shaped nozzles and the data given in the tables may be used for any desired shape of nozzle. In those cases where the nozzle has a solid center core, the data will also hold for the open area of the nozzle when equated to an equal open area for a nozzle without a solid center core section. Obviously when referring to round nozzles the nozzle dimensions of width and length are the diameter of the nozzle and the nozzle would perform similar to a square nozzle of equivalent outlet area. It should be noted that in the case of a rectangular nozzle the length (lo) is the long dimension along one side of the rectangle.

Only a few velocity curves for nozzle width and length are illustrated on the graph. But the preferred and maximum and minimum curves for location of the collecting surface relative to the nozzle outlet will apply to whatever the selected width and length of nozzle. For example, if the nozzle is ½ inch in width and 6 inches long, the preferred location of the collecting surface is 4 feet away from the nozzle outlet as shown on the graph and in Table II. The maximum distance is about 4.75 feet as shown on the graph along the zone 3 curve.

In the case of a two inch nozzle twelve inches long, the preferred location of the collecting surface is 5.6 feet from the nozzle outlet and the maximum distance is about 6.7 feet and the minimum is about 3.3 feet as shown on the graph. In this case, since the twelve inch long nozzle is less than 13.8 inches given in the table the equations of Table 2 are employed in calculating the distances which when calculated gives a maximum of 6.72 feet and a minimum of 3.38 feet which corresponds very well with the values on the graph. for a nozzle 1.0 inch in width and 5.0 feet long, the preferred location of the collecting surface is 5.0 feet away from the nozzle outlet and the maximum distance is about 6.2 feet with a minimum distance of about 2.9 feet as shown on the graph. In this case, since the nozzle length exceeds the twelve inches given in the table, the equation of Table I is used for calculating the location of the collecting surface. If a nozzle is 2.0 inch wide and eighty-eight inches long, the equation of Table I is used and as shown on the graph the preferred location of the collecting surface is 5.8 feet away from the nozzle outlet.

In all cases, collecting air is employed to prevent gravity free fall of the fibers and the collecting air is adjusted in each case for the desired collection characteristics which can be determined by observation. For best results, however, the velocity of the collecting air through the porous collecting surface is not less than about seventy-five percent of the impact velocity of the air-fiber stream. The impact velocity of the air-fiber stream at the collecting surface is readily measured with a standard flow meter or determined from the graph of FIG. 6 and the collecting air is then adjusted to a velocity greater than seventy-five percent or more of the impact velocity of the air-fiber stream. In most cases, the ratio of collecting air volume to the fiber air stream volume is maintained above 3 to 1 which means that the total air passing through the collecting web will be approximately four times the volume of air leaving the nozzle.

The concentration of fiber in the air stream may be varied depending on the desired physical characteristics of the web product. In general, the fiber concentration may be as high as 1.0 pound of fiber for each thirty cubic feet of air and as low as 1.0 pound of fiber for each one thousand cubic feet of air. The effective collection surface in a typical example would be an area of about 10 square feet. Thus, at the low concentration of 1.0 pound of fiber in one thousand cubic feet of air the total collecting air per pound of fiber would be about four thousand cubic feet which must pass through the ten square feet of collecting surface. In order to collect fiber at a practical commercial rate of about 600 pounds of fiber per hour about 40,000 cubic feet of air per minute at an average velocity of 4,000 feet per minute would have to pass through the ten square feet of collecting surface. This would require large fans and high power consumption. The most advantageous operating conditions are obtained by a fiber concentration of about at least 1.0 pound for each 250 cubic feet of air to about 1 pound of fiber for each thirty cubic feet of air at the specified fiber air stream velocity of about 2,000 to 10,000 linear feet per minute.

The preferred velocity of the air-fiber stream at the nozzle outlet is about 4,000 to 6,000 feet per minute with a fiber concentration of at least 1.0 pound of fiber for each 250 cubic feet of air in the air-fiber stream projected from the nozzle. Changing the nozzle configuration will, of course, effect the velocity of the air-fiber stream. If the nozzle velocity becomes excessive, it is only necessary to increase the nozzle width. If the nozzle width is doubled, the velocity of the stream is reduced to one-half.

In most applications it is of advantage to introduce an adhesive binder onto the fibers to achieve improved mat properties such as tensile strength and handleability. A common technique for introducing an adhesive binder is to apply it to the fibers after the mat has been formed. In this technique the formed mat is passed through either a series of liquid binder sprays or a bath of the liquid adhesive. The introduction of the binder by sprays tends to be non-uniform since most of the binder is deposited on the mat surfaces. The use of the bath or saturation technique results in collapse of the fiber structure and hence loss of unrecoverable loft. In the present invention it has been found that the introduction of an adhesive binder as a liquid spray prior to collecting the fibers on the porous collecting screen will overcome the above described shortcomings of binder that has been applied after the mat has been formed. Also, the present invention is compatable with either the separate or simultaneous introduction of dry powder adhesives onto the fibers prior to their collection onto the porous screen if said powdered adhesives are desired to provide a certain product quality. For best results, an adhesive binder spray or sprays are introduced into the air-fiber stream in zone 1 with the sprays directed substantially parallel to the air-fiber stream direction, but in certain instances the sprays may be tilted to a greater angle from the direction of the air-fiber stream with equivalent results. The best results are obtained when the binder is injected at a distance away from the air-fiber stream nozzle outlet which does not exceed four times the width of the air-fiber stream nozzle. With a two inch wide air fiber nozzle, the binder spray is preferably injected into zone 1, less than eight inches away from the nozzle outlet. However, satisfactory results may be achieved when the binder is injected into the air-fiber stream at a distance away from the nozzle up to twelve times the nozzle width. The spray nozzle may be positioned inside or outside the air-fiber stream. If the spray nozzle is outside the air-fiber stream, the binder spray is preferably directed to enter the air-fiber stream at a small angle. Locating the binder spray nozzle inside the air-fiber stream is preferred because the air-fiber stream forms an air curtain which tends to contain the binder spray and improve binder distribution in the web.

The air-fiber stream should not be greater than 1.0 inch wide and preferably less for uniform binder distribution on the fibers. If a wider air-fiber stream is employed, a plurality of spray nozzles are employed spaced apart so that each spray nozzle will inject binder into a portion of the air-fiber stream less than about 1.0 inch wide.

The amount of liquid carrier such as water in the binder spray should be kept to a minimum compatible with good spray formation. Preferably the ratio of the weight of liquid carrier to the weight of fiber in the air-fiber stream does not exceed 1.0 part by weight of water to 1.0 part by weight of fiber. The concentration of binder in the liquid carrier is controlled by the solubility of binder solids and the amount of binder solids desired for each pound of fiber in the web. In general, the binder solids dissolved in the water will be from about 5.0 to 100 percent of the weight of the water. At the 100 percent level there will be 1 pound of binder solids dissolved in each pound of water. For uniform distribution of binder, the velocity of the binder spray is preferably equal to or less than the velocity of the air-fiber stream.

In accordance with the present invention, fibrous webs and mats may be made very thin and of the nature of tissue paper with a product weight of only about 3.0 to 5.0 grams per square foot. Such low weight products are most advantageously formed by maintaining the nozzle velocity between 3,000 to 8,000 feet per minute with a fiber concentration of about 1.0 pound or less of fiber in each 150 cubic feet of air. Preferably the thin low weight webs are formed with a nozzle width of less than 1.0 inch and a fiber concentration of about 1.0 pound to each 150 to 250 cubic feet of air projected from the nozzle at an average velocity above 4,000 FPM and not over about 6,000 FPM. These thin tissue paper fibrous webs are made possible by the exceptional uniform random orientation of the individual fibers on the collecting surface without the clots and thin spots prevelent in the prior art web structures. Heavy mats or blankets with an exceptionally uniform random orientation of fibers may also be achieved. For example, a blanket may be formed which is about 1.0 inch thick and weighs only about 110 grams per square foot by increasing the fiber concentration to as much as three pounds per cubic feet of air, increasing the collecting air volume slightly, and slowing down the speed of the collecting surface.

BRIEF DESCRIPTION OF THE DRAWINGS

Further details and advantages of the present invention will be described in connection with the drawings which illustrate a preferred embodiment of the invention and in which.

DESCRIPTION OF THE PREFERRED EMBODIMENTS

Figure 1:
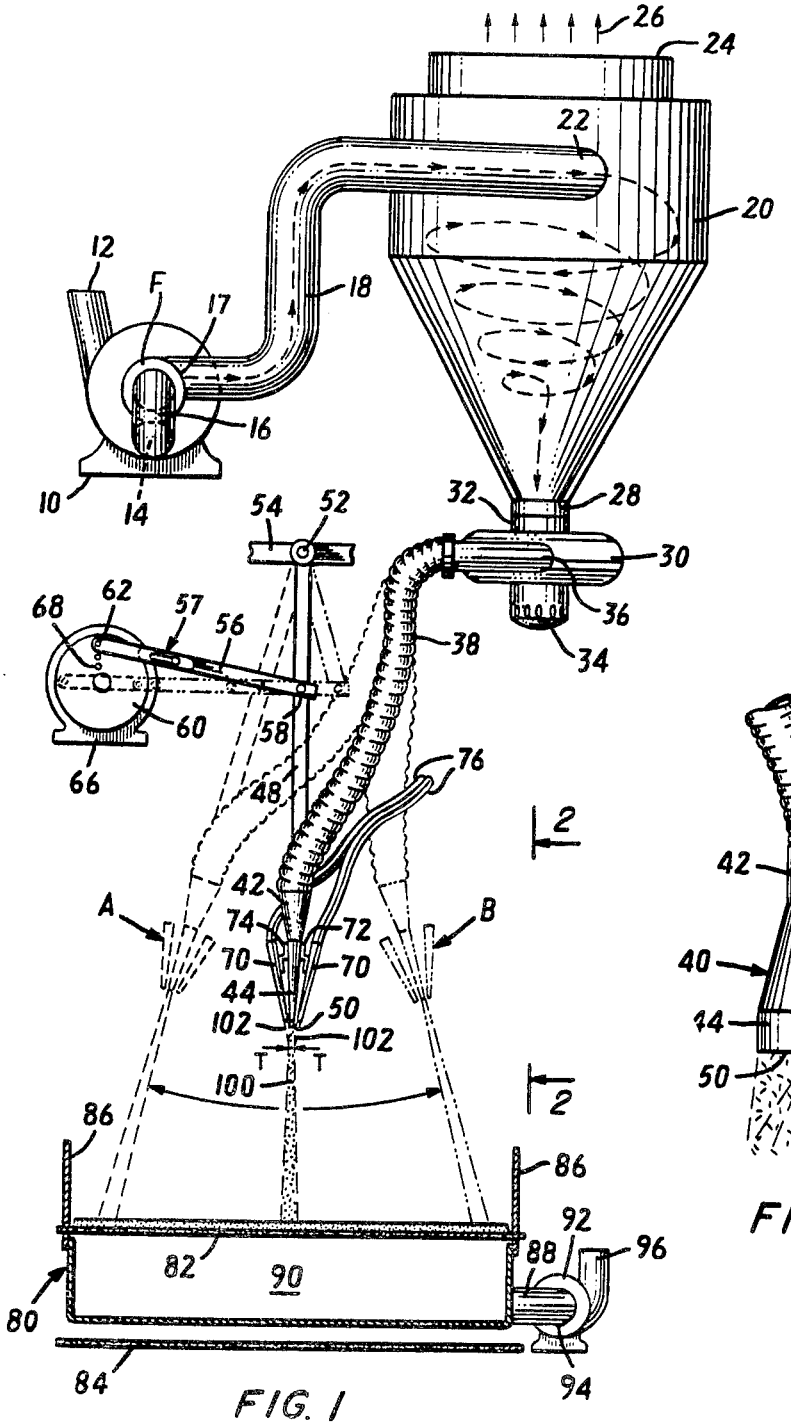
FIG. 1 is a schematic showing of the preferred apparatus of the invention.

As shown in FIG. 1, the apparatus comprises a conventional hammermill 10 having an inlet chute 12 for fiber (either in lap form or bulk) and air, and an outlet 14 for the air-fiber suspension leading through duct 16 to the inlet of fan F driven by the same shaft as hammermill 10. The outlet 17 of the fan F is connected by means of a conduit 18 to the inlet 22 of a conventional cyclone separator 20.

The cyclone 20 has an upper excess air outlet 24 for the removal of excess air from the air-fiber suspension in the direction indicated by the arrows 26. The cyclone 20 also has an outlet at its lower end 28 connected to the inlet 32 of a high speed blower 30 driven by the electric motor 34. The high speed blower 30 has an outlet 36 connected by a flexible conduit 38 to a felting nozzle generally indicated at 40.

Figure 2:
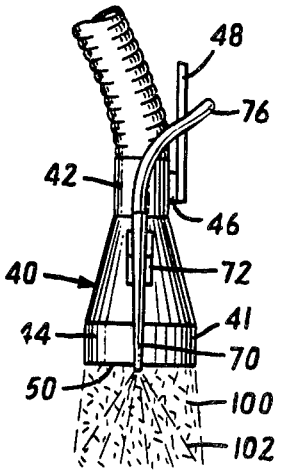
FIG. 2 is a view taken along the line 2—2 of FIG. 1.

The felting nozzle 40 is of sheet metal or like construction and has a round upper end 42 connected to the flexible conduit 38. The circular section 42 changes shape to a generally flat or rectangular lower portion 44 to provide a substantially rectangular nozzle outlet 50 of the same cross-sectional areas as section 42 and duct 38 or somewhat smaller. The nozzle outlet 50 preferably is not of any greater cross-sectional area than the section 42 and duct 38. As best shown in FIG. 2, in those cases where it may be desirable to oscillate the nozzle 40, it may be secured by any suitable means such as by welding to a block 46 in turn secured in any conventional manner to the lower end of a vertical rod 48. The means of securing the nozzle 40 to the rod 48 is not critical.

The upper end of the rod 48 is pivoted at 52 to any convenient portion of the frame 54 by any suitable means such as conventional journal and pin arrangement. Intermediate the ends of the rod 48, a second rod 56 is pivoted at 62 to a rotating eccentric 60 supported upon the shaft 64 of an electric motor 66. The eccentric 60 has a number of openings therein so that the left hand end of the rod 56 (as viewed in FIG. 1) may be adjusted at various distances from the center of the eccentric 60 in order to adjust the throw of the oscillating bar 48. The rod 56 is provided with a slotted adjustment 57 which permits equalizing the arc of oscillation after positioning the left hand end of rod 56 in the eccentric 60. Also supported from the lower end of the oscillating bar 48 by means of brackets 72 and 74 are a pair of cooperating binder outlet nozzles 70. Hoses 76 connect the nozzles 70 to a suitable source (not shown) of liquid binder. Any number of conventional atomizing type liquid sprays are available for providing the liquid binder in atomized form as it exits from the nozzles 70. Either air-type or airless sprays may be used to form a spray of binder. In general, a flat fan shaped spray pattern is preferred with a nozzle of rectangular cross-section.

Beneath the nozzle outlet 50 is a suitable collection mechanism 80 preferably incorporating a continuous screen 82 usually electrically driven and of any of several conventional types. This screen 82 moves continuously beneath the nozzle outlet 50 in a direction perpendicular to the drawing in FIG. 1. This is to say that the viewer of FIG. 1 is looking at a cross-section through the conveyor screen 82 with the upper run being on top and the lower bottom run being 84. In the area where the felting from the nozzle 40 takes place, the upper run of the conveyor screen may be bordered by suitable deckels 86 on either side of the screen 82. Beneath the upper run of the collection screen 82 there is a suction box 90 connected by means of a conduit 88 to a suitable suction fan 92. The suction fan 92 has an inlet 94 connected to the conduit 88 and an outlet 96 to the atmosphere. The drawing illustrates a preferred form of apparatus but other forms of apparatus may be employed such as those described in U.S. Pat. Nos. 3,494,992 and 3,622,077.

METHOD AND OPERATION

In operation, the hammermill 10, the motors 34 and 66, the driving mechanism for the conveyor 80, and the exhaust fan 92 are energized as well as the liquid binder spraying mechanism connected to the spray nozzle 70 if it is desirable to incorporate binder into the web structure at this stage of manufacture.

Fiber is fed into the inlet 12 of the hammermill 10 to be broken up into substantially individualized fibers which are entrained in the air drawn in through the inlet 12 to create an air-fiber suspension. Many cellulosic type fibers are suitable for use in this invention although it has been found that the shorter fibers such as fibers of one-half inch or shorter are preferred and at least fifty percent of the fibers have a length of about 0.25 inch or less. Examples of such fibers are sulfite pulp fibers, cotton linters, and chopped fibers of various kinds including synthetic fibers.

The air-fiber suspension is conveyed by the blowing action of the fan F through the conduit 18 into the cyclone 20 where the air-fiber suspension may if desired be concentrated by the removal of excess air. While the use of considerable air is advantageous when breaking up the fiber lap or the bulk fiber into individualized fibers and for initial creation of the air-fiber suspension, it has been found that the quantity of air necessary for suitable individualizing of the fibers at the hammermill is sometimes in excess of that ideally required for proper felting according to this method. In such case, the cyclone 20 may be used to remove approximately one-half or more of the quantity of air introduced by the hammermill 10 and fan F while at the same time retaining the fibers in individualized form in an air suspension. As the air-fiber suspension issues from the exit 28 of the cyclone 20, the air-fiber ratio should be that described hereinabove. Preferably, there is not more than about 1.0 pound of fiber per each thirty cubic feet of air and for some applications 1.0 pound of fiber for each 150 to 250 cubic feet of air is preferred. This ratio of fiber to air in the suspension will, of course, be the same ratio as the air-fiber stream that issues from the nozzle outlet 50.

The air-fiber suspension enters into the high speed blower 30 through the inlet 32 and exits therefrom through the outlet 36 and the conduit 38 leading to the nozzle 40. The high speed (low volume) blower 30 imparts additional velocity to the air-fiber suspension and, to some extent, further insures the break up of any remaining fibers that have not been quite thoroughly individualized. The blower 30 preferably rotates at about 12,000 rpm with this speed being adjustable to between 5,000 rpm and 15,000 rpm.

The air-fiber suspension issues from the outlet 50 of the nozzle 40 as a sheet-like stream 100 which passes through zones 1, 2 and 3 as described hereinabove depending on the location of the collecting screen 82 in accordance with the formulae given hereinabove. The speed of the high speed blower 30 is adjusted such that the stream 100 issues from the outlet 50 at a speed of at least about 2,000 to about 10,000 linear feet per minute and preferably between about 4,000 to 6,000 LFM. When a liquid binder is used the thickness of the stream 100 as shown by the arrows "T" in FIG. 1 is preferably not over one inch at its point of exit from the nozzle outlet 50 but in any event the size of the nozzle and its configuration will determine the thickness of the stream. That is not to say that the nozzle outlet 50 itself necessarily controls the thickness of the air-fiber stream 100. In many instances this will be so; however, if the opposing nozzle walls, identified as 41 in FIG. 2, form a converging angle above the outlet for example, the air-fiber stream may issue from the outlet 50 of the nozzle at a considerably thinner thickness at the section T—T than the thickness of the outlet itself.

The projected velocity of stream 100 and the distance it travels in transit through zones 1 and 2 and the beginning of zone 3 and the amount of collecting air is controlled as described hereinabove. In one example, 1.0 pound of fiber was suspended in 125 cubic feet of air and projected from the outlet 50 of the nozzle at an average velocity of 5,000 linear feet per minute. The nozzle was one-half inch wide and six inches long. The collecting screen 82 was positioned 4.0 feet away from the outlet 50 of the nozzle and the collecting air was drawn through screen 82 at a velocity of 1,200 linear feet per minute. Approximately one hundred percent of the fibers were less than one-eighth inch long. Referring to the graph of FIG. 6 of the drawings, it will be seen that the collecting screen was located on the curve $Y = X^2/80$. The fiber web structure collected on the screen was about 3/16 inch thick with a product weight of about 20 grams per square foot. The product exhibited an excellent uniform random orientation of the individual fibers. This product can be used in combination with appropriate surface liners as an absorbent medium in diaper liners or said product can be formed thicker by slowing down conveyor screen 82 to produce a pad which can be plied up and cut to the required dimensions for use as padding in disposable sanitary napkins.

In a second example a liquid adhesive binder was employed comprising 0.25 pounds of binder solids for each 1.0 pound of water. The binder solids were a copolymer of vinyl chloride. The binder spray was injected into the air-fiber stream as illustrated in FIG. 2 at a velocity of about 4,500 linear feet per minute. In this second example, 1.0 pound of fiber was suspended in 150 cubic feet of air and projected from the outlet 50 of the nozzle at an average velocity of 4,200 linear feet per minute. The nozzle was ¾ inch wide and 15 inches long. The collecting screen 82 was positioned 4.0 feet away from the outlet 50 of the nozzle and the collecting air was drawn through screen 82 at a velocity of 1,100 linear feet per minute. Approximately one hundred percent of the fibers were less than ⅛ inch long. Referring to the graph of FIG. 6 of the drawings, it will be seen that the collecting screen was located close to the curve $Y = X^2/80$. The fiber web structure collected on the screen was approximately ⅛ inch thick with a product weight of 12 grams per square foot. The product exhibited an excellent uniform random orientation of the individual fibers. The product can be used for padding under vinyl film such as employed in embossed automotive door panels where the vinyl binder is fused to both the vinyl film and a backer material by an embossing press. In this product application, the uniformity of the fiber and binder distribution is highly critical. If the distribution is not uniform the vinyl surface will appear to be lumpy and the bonding between the vinyl facing and the backer material may break loose.

The liquid binder of spray 102 is able to reach even those fibers in the center of the screen 100 without the formation of clots or disruption of the stream integrity. One of the difficulties experienced with previous methods is that as the air-fiber stream was too thick to allow penetration of the binder spray to the center of the stream. The binder spray would strike the outer portion of the air-fiber stream and be deflected more or less parallel to said stream with only the fibers in the extreme outer portion of the air-fiber stream itself being coated with the binder spray. Additional turbulence was, in fact, required to achieve adequate mixing of the binder and fiber. Thus, it was necessary to collect the fibers at a point beyond the curve $Y = X^2/135$ to assure adequate mixing of the binder and fiber. However, this desired turbulence caused contact of the wetted fibers with the non-wetted fibers prior to deposition on the collecting surface with the result that the formed mat consisted of layers of poorly distributed clots. Such is not the case under the circumstances of this invention since the stream is very thin and turbulence is only employed under certain specified conditions at the beginning of zone 3 near the end of the distance traveled by the stream. The liquid binder spray 102 in accordance with the present invention is able to adequately uniformly attach even to these fibers in the center of the stream without creating clots of pluralities of fibers bound together by the binder.

The length of air-fiber stream 100 (left to right in FIG. 2) is selected as described hereinabove which may be any length suitable for the particular product being made. The speed of the conveyor screen 82, and the design of the equipment capacity is adjusted to the desired product. The binder spray 102 is applied preferably at a slight angle to the direction of the flow of the air-fiber stream 100 and preferably as close as practical to the thinnest point of the air-fiber stream. If the sprays are located inside the stream they are directed parallel to the stream and again preferably as close to the thinnest point of the stream as possible. This insures good penetration of the binder spray 102 into the air-fiber stream 100 and permits excellent uniformity of application of the binder to the fibers.

The suction fan 92 is, of course, operated in order to provide a flow of air downwardly through the screen 82 and into the suction chamber 90 therebeneath. This aids in holding the fibers in position once they have been felted to the screen 82. The flow of air through the growing mat and the screen 82 into the suction box 90 also aids in prevention of gravity free fall of fibers and turbulence adjacent the surface of the screen and the growing mat. This air flow also tends to dry the liquid binder in the growing mat and thus reduces the drying load on subsequent drying ovens.

The felting of fibrous mats in accordance with the present invention may be carried out with nozzle 40 in a set stationary position and with the long axis of the nozzle oriented in any desired direction. But, if desired, the motor 66 may be operated in order to oscillate the arm 48 and with it the air-fiber stream nozzle 40 as well as the binder nozzles 70 as indicated by the dashed line positions "A" and "B" shown in FIG. 1. The adjustments 68 permit the throw of the arm 48 to be adjusted to a greater or a lesser arc as may be required by the width of the product being produced. Because the mat will be formed somewhat wider than the limit of the arc at the conveyor 82, the arc is adjusted to be slightly less than the width of the desired product as shown in FIG. 1. The deckels 86 are adjustable toward and away from each other for various product widths. During oscillation, of course, the air-fiber stream 100 with the binder from the spray 102 applied to the fibers thereof, is laid down in a sweeping and lapping fashion across the width of the moving screen 82.

One of the anticipated problems in felting the mat was that the outer surfaces of the air-fiber stream would at times have a somewhat lesser concentration of fibers than the center of said stream. This appeared to pose a problem especially at the reversal point in the oscillation of the nozzle which is located next to the deckles. For example, it appeared that less fibers might be deposited on the screen next to the deckles than at the center portion of screen 82. This tendency is overcome by stopping the oscillation short of the deckles and allowing the inertia of oscillation to distribute the fibers uniformly close to the deckles. Thickness uniformity can be maintained within one inch distance from the deckle surfaces.

It has been found, similarly, that the "lapping" effect above referred to and the limited flaring of the air-fiber stream at the collecting surface contribute to the uniformity of the mat produced. The speed of oscillation is controlled by the speed of the motor 66 and is adjusted to correspond with the speed of the screen 82 thus permitting the formation of a continuous mat on the screen 82. This adjustment is preferably made such that each traverse of the stream overlaps a portion of the mat laid down by the previous traverse to just the proper amount to even out any thinness caused by any tendency for the fibers to be less concentrated at the outer surface of the stream. At a downstream station (not shown) the mat may be lifted from the screen 82 and pressed between rolls if desired to a controlled thickness and then passed into a drying oven in known manner if necessary. Said screen surfaces 82 and 84 may consist of materials with low adhesion coefficients such as Teflon which reduce tendency for the mat to stick to the screen. Alternatively, if the mat formed in quite thin, it may be transferred to and dried on suitable drying rolls also in known manner or the air passed through the product by the suction box 90 may be adequate, particularly if its moisture capacity is increased such as by heating.

Various liquid binders may be used including particularly starch sols and various liquid latex binders as well as other liquid binders or suspensions in a liquid such as resins, it being only necessary that the binder be adequately atomized when applied to the air-fiber stream. As pointed out hereinabove, solid binders such as various powdered binders may also be used. These may be blended in conventional manner with the fiber prior to passage through the blower 30.

Figure 3:
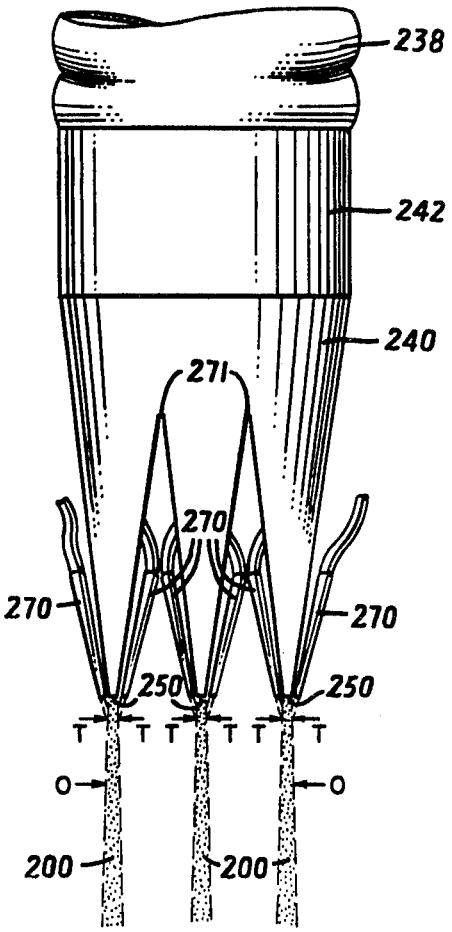
FIG. 3 shows one modification of the apparatus.

Various modifications of the apparatus are also possible. A plurality of separate nozzles may be used to project the air-fiber stream toward the support. If desired, the separate nozzles may be combined into a single unit in order to use a single feed for the plurality of nozzles. As shown in FIG. 3, there is a single flexible duct 238 leading from a single high speed blower such as that indicated at 30 in FIG. 1. The flexible duct 238 is connected to an inlet 242 of a nozzle 240 comparable broadly to the nozzle 40 shown in FIGS. 1 and 2. The nozzle 240 has a plurality of outlets 250 each of which is roughly comparable to the outlet 50 shown in FIGS. 1 and 2. Binder nozzles 270 are arranged on either side of each of the outlets 250 in the same manner generally as the relationship between the nozzles 70 shown in FIGS. 1 and 2 with respect to the outlet 50 therein. The plurality of nozzles 250 shown in FIG. 3 are provided by inverted "V" divider strips 271 arranged longitudinally of the interior of the basic nozzle head 240. It will be seen, therefore, that from one flexible supply duct 238 and from one nozzle head 240 a plurality of streams 200 can be provided by the inverted "V" divider strips 271 as shown in FIG. 3. It will be appreciated that when reference is made herein and in the claims to the thickness of the air-fiber stream, reference is had to the thickness dimension indicated by the arrows "T—T" as shown in FIG. 1 as well as to the same thickness as indicated in FIG. 3 by the three sets of arrows marked "T—T". That is to say that each of the streams 200 has a thickness at the point indicated by the arrows marked "T—T" in FIG. 3. Conversely, the thickness of the air-fiber stream as referred to herein is not the overall thickness as indicated by the arrows "O—O" in FIG. 3. In effect, therefore, the device of FIG. 3 is merely a plurality of nozzles similar to the nozzle 40, as shown in FIG. 1 provided from a single nozzle head 240 and a single flexible supply duct 238. Location of collecting screen 82 relative to the air fiber nozzle is determined on the basis of calculations for only one stream as described hereinabove.

Figure 4:
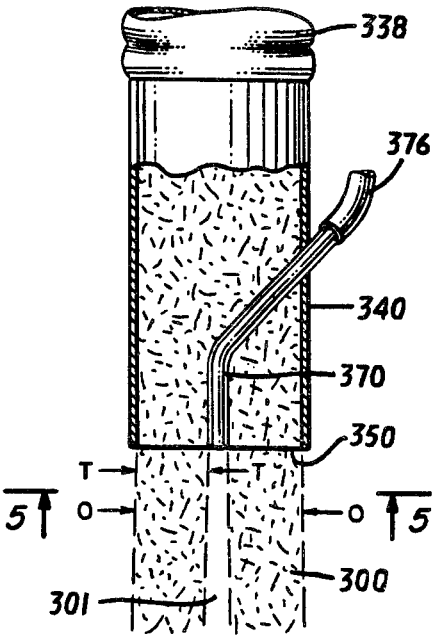
FIG. 4 shows a second modification of the apparatus.
Figure 5:
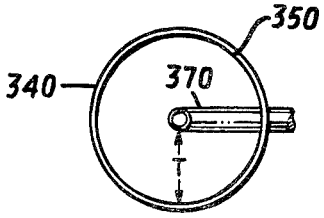
FIG. 5 is a view taken along line 5—5 of FIG. 4.

Another modification of the apparatus is shown in FIG. 4. While the elongated nozzle outlet 50 and the elongated stream 100 as shown in FIG. 1 and the similar multiple nozzles and streams 250 and 200 respectively shown in FIG. 3 are preferred, cylindrical nozzle 340 as shown in FIG. 4 may also be utilized. The cylindrical nozzle 340 as shown in FIG. 4 is supplied from a single flexible supply duct 338 connected at its other end (not shown) to a high speed blower arrangement such as that shown at 30 in FIG. 1. The cylindrical nozzle 340 has an outlet 350 and an internal binder nozzle 370 which extends inwardly and downwardly in a smooth curve from a portion of the wall of the nozzle 340. The binder nozzle 370 is connected externally of the nozzle 340 to a suitable flexible hose 376 which is in turn connected to a source of liquid binder. It will be appreciated that since the nozzle 370 extends downwardly to about the position of the lower end of the nozzle 340 that the liquid binder nozzle 370 in part defines the outlet 350 together with the lower edge of the nozzle 340. Under the circumstances, the air-fiber stream 300 is circular in nature and has a central opening 301 therein. It will be appreciated that when reference is made herein and in the claims to the thickness of the air-fiber stream reference is being made to the dimension indicated by the arrows "T—T" as shown in FIG. 4 and not to the larger outside dimension indicated by the arrows "O—O". Location of the collecting screen relative to the outlet of nozzle 340 is determined as specified hereinabove by calculation for a round opening with a diameter that provides an area equal to the open area of thickness "T—T". FIG. 5 is a view from beneath along the line 5—5 of FIG. 4 again showing, but in a different view, the thickness "T" which is the thickness of the air-solids stream referred to.

Still further modifications are contemplated. While reference has been made to the use of but one nozzle such as the nozzle 40 in FIG. 1 with a cooperating pair of binder nozzles 70, it will be appreciated that for nozzles 40, with a greater left to right length of face 41, a plurality of binder nozzles 70 may be required on each side. Also, for extremely wide screens 82, a plurality of nozzles 40 with associated binder nozzles 70 and including a plurality of supply ducts 38 supplied either from a single or a plurality of high speed blowers 30 may be required. In such circumstances, the nozzles 40 would be arranged parallel to each other and in one or more rows as viewed from left to right in FIG. 1. For other applications, including products of considerable thicknesses, for high speeds of the conveyor 82, or for laying down two mats or more on top of each other either of similar or different make up, it may be desirable to arrange a plurality of rows of nozzles 40 together with associated binder nozzles and supply ducts longitudinally of the conveyor screen 82.

Figure 6:
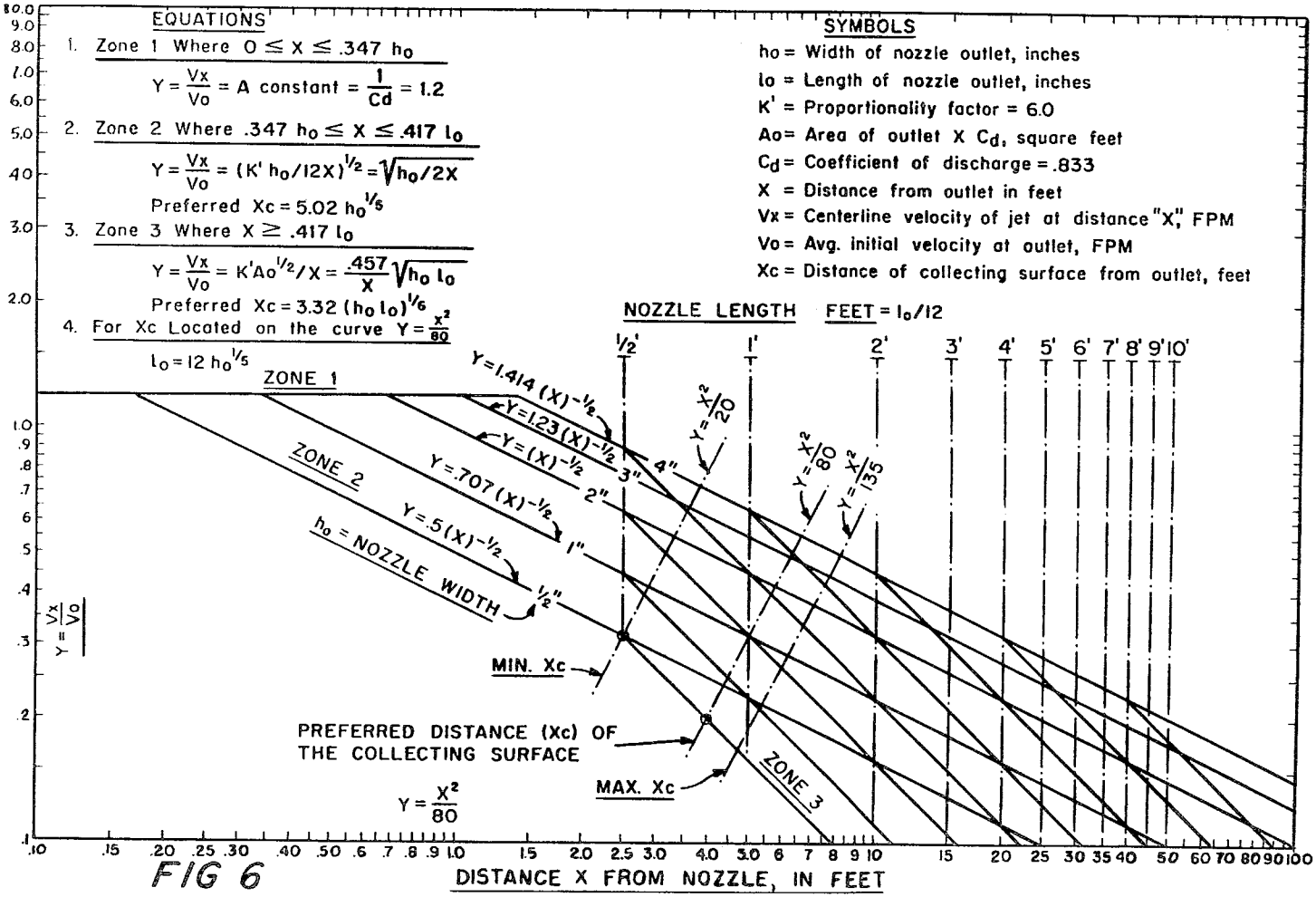
FIG. 6 is a graph of velocity curves of the air-fiber stream in transit from the projecting nozzle to the collection support.

As indicated above, the preferred distance under the circumstances outlined for the distance between the outlet 50 and the screen 82 will lie close to the curve $Y = X^2/80$ shown in FIG. 6. If screen 82 is too far from the outlet 50, and the air fiber stream tends to slow down and back up on itself thus permitting the fibers to touch one another and therefore form clots. If the screen 82 is too close to the outlet 50, the force of the air-fiber stream 100 impinging upon the screen 82 will cause severe impact at the screen face again causing considerable clotting and blowing of the forming mat off the screen.

While the preferred method is described above, including the use of a liquid binder, various modifications of the process are possible to produce different product characteristics. For example, depending upon the use to which the product is to be put and the nature of the fibers and their characteristics including their length it is possible to produce a mat by this method in which the fibers are sufficiently interfelted as to provide strength and integrity to the mat without the need for any added binder including the applied liquid binders as above disclosed. Accordingly, under such circumstances, it is only necessary to shut off the liquid binder nozzles 70. For other products and applications it may be preferred to use a dry binder such as the various powdered thermoplastic resins such as the various acrylic, styrene, vinyl, polyolefin and polyester resins and the like. Such dry binder material may be fed into the hammermill 10 along with the fiber in measured amounts. Normally, the amounts of such solids will be between 4 and 30 pounds of powder for each 100 pounds of fiber; but, again, this depends upon the particular product and product characteristics desired. Various thermosetting resins such as powdered phenolic, urea-formaldehyde, melamine-formaldehyde, and some epoxy resins may also be introduced into the hammermill 10 with the fibers. In each of these circumstances whether the introduced dry binder resins are thermoplastic or thermosetting they may be activated after formation in a suitable oven or may, for example, have been included for the purposes of molding in a press such as is commonly done with the various phenolic resins. In either case the use of the liquid binders above mentioned may or may not be necessary depending upon the amount of handling, the product characteristics desired and the characteristics of the fibers being used. For example, it may be preferred for a particular product to use a small quantity of starch sol applied by the binder nozzles 70 in order to hold the mat together during subsequent handling and use even though included in the mat is a quantity of powdered resin which may be activated either immediately after formation or at some later time at a different location such as may occur when molding a blanket to form a molded article. On the other hand, if the fibers permit and provide enough integrity to the mat there may well be instances when solids such as powdered resins may be incorporated in the air-solids suspension when no liquid binder need be applied by the nozzle 70. For example, if the mat is to be moved down the line by machine and the dry binder activated by heat, the integrity of the mat contributed by the fibers themselves, may be sufficient to not require the added liquid binder.

Various additives in liquid or solid form may be incorporated in the mat such as color dyes, fire retardants, seeds for grass, vegetables, and the like. In liquid form these may be included by spraying through the nozzle 70 either in combination with the liquid binder, if any or alone. If in solid form, these may be included by introduction into the inlet 12 of the hammermill 10. It has been found, for example, that a very suitable mat incorporating grass seed may be produced without any detrimental effect to the seed by the blowers and other mechanisms simply by introducing the seed in the desired quantity by a tube inserted into the outlet 24 of the cyclone collector. Such a product, bound with a starch binder applied by the nozzles 70, can be laid upon the open ground and when watered both the starch binder and the fibers will disintegrate slowly while holding the grass seed long enough for it to germinate the root.

Whenever added, solids are provided whether they be powdered resins, fire retardants, seeds, or any other additive, their weight is included in determining the quantity of air used. For example, for some particular product there may well be 150 cubic feet of air per pound of solids wherein the pound of solids is made up of 0.1 pounds of phenolic resin and 0.9 pounds of fibers. The quantity of fibers can vary widely, but the fibers are essential to the production of the felted mat. Additionally, when the quantity of fibers drops much below 50% by weight of the total solids the air-solids stream becomes so dusty as to present difficulties in the environment and in retention upon the screen 82. As used herein and in the following claims, the reference to "solids" includes fiber as well as any dry powdered binder, fire retardants, seeds for grass, and the like in dry form suitable for inclusion in the air-solids suspension.

Products produced according to this invention have been shown by measurements to have significantly improved coefficients of uniformity indicating lack of clotting, better fiber distribution, better felting, thus giving products with enhanced uniformity, loft, stretch, drape, softness, and resiliency.

An appreciation of the uniform orientation of the felted fibers in mats produced in accordance with the present invention will be realized from optical tests showing transmission of light through the mat.

A new method based on the laws of optics has now been developed for determining uniformity of the orientation of fibers in felted mats. Briefly stated, the method consists of projecting a beam of light of fixed intensity through the mat onto a photocell. The photocell is connected to a light meter to provide a quantitative value of the transmitted light. A sample of the mat to be tested is placed directly over an opaque plate containing a single one-half inch diameter hole which restricts the light transmitted to the photocell to that passing through a one-half inch circle in the mat. In this way, the transmitted light (I) is recorded for a multitude (n) of regularly spaced spots in the mat. A base light intensity ($I_o$) without having a mat in place over the opaque plate of about 200 to 250 foot candles is satisfactory for most tests and the meter reading for the base light is also recorded. The recorded light intensity (I) may be translated into an equivalent weight value (w) and the variance ($s^2$) or the standard diviation (s) of these weight values relative to the average weight of the entire sample ($\overline{w}$) will give a coefficient of variation (CV) for the sample. The average weight of the entire sample ($\overline{w}$) is determined by dividing the total weight of the sample by its area to obtain the weight per unit of area. The coefficient of variation (CV) provides a quantitative value for comparing the uniformity of the felted fibers in the mat against that of other mats examined in a similar manner.

The formulae used in calculating the above values are as follows:

$$w = k\,(\text{Log } I_o - \text{Log } I) \text{ and} \qquad \text{Equation 1}$$

$$k = \overline{w} / \left(\text{Log } I_o - \frac{\Sigma \text{Log } I}{n}\right)$$

$$CV = \frac{s}{\overline{w}} \times 100 = \qquad \text{Equation 2}$$

$$\sqrt{\frac{\frac{1}{n-1}\left[\Sigma(\text{Log } I)^2 - \frac{(\Sigma \text{Log } I)^2}{n}\right]}{\text{Log } I_o - \frac{\Sigma \text{Log } I}{n}}} \times 100$$

The (CV) in the above formulae is expressed as a percent and the lower the (CV), the more uniform the mat. The term optical coefficient of variation as used in the specification and claims is intended to mean the CV value determined in accordance with the formulae set forth hereinabove.

In the examples set forth in Table III, $\overline{w}$ and s are in grams per square feet; $I_o$ and I are in foot candles; n is the number of readings of I taken through the tested sample which was a 12 inch square.

TABLE III

| | PARAMETERS | | | | | UNIFORMITY | | |
|---|---|---|---|---|---|---|---|---|
| SAMPLE | N | $\overline{w}$ | $I_o$ | $\Sigma$(LogI) | $\Sigma(\text{LogI})^2$ | k | S* | CV |
| A. Commercial tracing paper or vellum (.005" thick) | 32 | 5.7 | 242 | 55.8403 | 97.4433 | 8.92 | ±.061 | 1.07% |
| B. Web produced by present invention with liquid binder (.143" thick) | 32 | 15.0 | 242 | 36.0162 | 40.5811 | 11.92 | ±.45 | 3.02% |
| C. Commercial web with liquid binder (1/4" thick) | 32 | 33.6 | 242 | 29.7846 | 28.1603 | 23.12 | ±2.7 | 8.18% |

*S is the standard deviation which can be obtained from $$S = \frac{CV \times \overline{w}}{100}$$

As shown above, there is a big difference in uniformity of the products. Sample A is a commercial tracing paper or vellum formed in conventional manner from an aqueous slurry of fiber from which the water is withdrawn. Controls have been perfected for obtaining a uniform dispersion of fibers in the aqueous slurry used in the wet processes conventionally employed in the manufacture of paper and the uniformity of fiber dispersion in the product is excellent. However, up until the time of the present invention there has been no attempt in the known commercial air-fiber stream felting processes to control the air-fiber stream during transit from the nozzle to the collecting surface for the mat. This is illustrated by Sample C which is a commercial fibrous mat deposited by gravity on the porous collecting surface (Duval patent process). The distribution of fibers in Sample C does not approach the uniformity of that obtained by the wet process. There are many clots of fiber and thin spots in the mat of Sample C which are objectionable and tend to make the mat unsuitable for use in a number of commercial applications. As a matter of fact, Sample C represents the minimum weight that can be produced by the process. If a lower weight mat is attempted the number of fiber clots are not sufficient to adequately cover the forming surface and, as a result, large voids or holes appear in the mat.

The mat of Sample B was produced in accordance with the present invention using the above specified control of the air-fiber stream in transit from the nozzle to the collecting support and, as shown in Table III, the distribution of individual fibers in the mat is quite unexpectedly close to that of mats produced in the conventional wet process. The uniformity of fiber felting and orientation in mats produced by the present invention makes it possible to produce very thin light weight mats comparable to paper which have not heretofore been possible with conventional air-fiber stream felting processes. These light weight felted mats produced in accordance with the present invention have an optical coefficient of variation not greater than about 6.0%.

The invention permits flexibility in the production of air-fiber stream felted products. For example, extremely low density products as low as about 1 pound per cubic foot may be produced and products with considerable densities can also be produced. Densities as high as 60 pounds per cubic foot are possible by pressing the felted mat. Thicknesses may range from 4 mils to about 1 inch. However, fibers which upon felting on the support present a low porosity to the collecting air flow, can be felted to greater thicknesses than those fibers providing a lower porosity.

Unlike most previous air felting systems, no confined space such as large chambers or casings are required by this method since the required integrity of the air-solids stream is maintained during its travel through the free surrounding air from the nozzle outlet 50 to the screen 82 thus avoiding the cloud-like or snowstorm gravity free fall effect in most chambers which tend to produce clots.

Products made by this method have a myriad of uses including package wrapping and cushioning, furniture and mattress cushioning, filler materials for furniture and books, various embossed application, paper-like products particularly disposable products such as diapers, wiping cloths, filters, liquid absorbers, cloth for draperies, clothing, liners, sanitary napkins, and the like. When air permeable molds are used various molded products may be produced including dash, hood, roof and trunk liners for automobiles and other molded shapes for numerous applications.

It will be understood that the claims are intended to cover all changes and modifications of the preferred embodiments of the invention, herein chosen for the purpose of illustration, which do not constitute departure from the spirit and scope of the invention.

What is claimed is:

1. The method of forming a felted fibrous structure having an improved coefficient of uniformity of random orientation of fibers therein by projecting an air fiber stream containing cellulosic type fibers with length of 0.25 inch or less from a nozzle for collection on a porous collection surface comprising the steps of:

(a) forming a relatively dilute air suspension of substantially individualized cellulosic type fibers in which at least one half of the fibers have a length of 0.25 inch or less;

(b) selecting a nozzle with outlet of a rectangular type configuration from about 0.5 to about 4.0 inches wide and from about 0.5 inch to about 10.0 feet long for projecting said air suspension of fibers as a jet stream;

(c) positioning said nozzle above said porous collection surface with the nozzle outlet from about 2.5 feet to about 8.25 feet away from said collection surface;

(d) projecting said air suspension of fibers from said selected nozzle as a jet stream at a linear velocity of at least 2,000 feet per minute to about 10,000 feet per minute toward said collection surface;

(e) applying suction to the opposite side of said porous collection surface from that which faces the nozzle to draw collecting air through the porous collection surface; and (f) correlating the selected nozzle configuration to the distance between the nozzle outlet and collection surface and positioning the nozzle outlet at a selected correlated distance above the collection surface where the fibers in said projected jet stream will move as individualized fibers without formation of clots in a uniform and direct path from said nozzle to said collection surface and from thereon a felted structure in which the fibers are uniformly felted in random orientation to provide an optical coefficient of variation not greater than about 6.0 percent.

2. The method of claim 1 which includes the step of selecting a nozzle outlet other than a rectangular type which has an outlet area equivalent to the said rectangular type nozzle outlet configuration.

3. The method of claim 1 which includes the steps of:

(a) selecting a nozzle outlet configuration which projects a jet stream of said suspended fibers not over about 1.0 inch wide; and (b) injecting a liquid binder into the jet stream of suspended fibers between a position located adjacent to the outlet of the nozzle and not over about 12 inches away from the nozzle outlet in a direction toward said collection surface.

4. The method of claim 1 which includes the steps of holding the nozzle in a stationary position for projecting said air fiber stream to the support and correlating the size of the collection surface to the nozzle configuration so that substantially all of the fibers in the air jet stream are collected on the support.

5. The method of claim 1 which includes the step of oscillating said nozzle.

6. The method of claim 1 which includes the step of collecting substantially all of said fibers from said projected jet stream on the porous collection surface to form said felted fibrous structure.

7. The method of forming a felted fibrous structure having an improved coefficient of uniformity of random orientation of fibers therein by projecting an air fiber stream containing cellulosic type fibers with length of 0.25 inch or less from a nozzle for collection on a porous collection surface comprising the steps of:

(a) forming a relatively dilute air suspension of substantially individualized cellulosic type fibers containing no more than about 1.0 pound of fiber for each 100 cubic feet of air in which at least one half of the fibers have a length of 0.25 inch or less;

(b) selecting a nozzle with outlet of rectangular configuration from about 0.5 to about 2.0 inches wide and from about 0.5 to about 6.0 feet long for projecting said air suspension of fibers as a jet stream;

(c) positioning said nozzle above said porous collection surface with the nozzle outlet from about 2.5 feet to about 7.1 feet away from said collection surface;

(d) projecting said air suspension of fibers from said selected nozzle configuration as a jet stream at a linear velocity between about 2,000 to 10,000 feet per minute into an unconfined air space without any enclosure surrounding said jet stream during transit from the nozzle to the collection surface;

(e) applying suction to the opposite side of said porous collection surface from that which faces the nozzle to draw collecting air through said porous collection surface in a volume of not less than about three times the volume of the air fiber stream projected from said nozzle at a velocity of not less than about 75 percent of the impact velocity of said air fiber stream on the collecting surface; and (f) correlating the selected nozzle configuration to the distance between the nozzle outlet and collection surface and positioning the nozzle outlet at a selected correlated distance from the collection surface where the fibers in said projected air stream will move as individualized fibers without formation of clots in a uniform and direct path from said nozzle to said collection surface and form thereon a felted structure in which the fibers are uniformly felted in random orientation to provide an optical coefficient of variation not greater than about 6.0 percent.

8. The method of claim 7 which includes the steps of:

(a) selecting a nozzle outlet configuration which projects a jet stream of said suspended fibers not over about 1.0 inch wide; and (b) injecting a liquid binder inside the exterior of said jet stream of suspended fibers between a position located adjacent to the outlet of said nozzle and not over about 4.0 inches away from the nozzle outlet toward said collection surface.

9. The method of claim 7 which includes the steps of oscillating said nozzle.

10. The method of claim 7 which includes the steps of:

(a) selecting a nozzle configuration having an outlet of about 0.5 inch wide; and (b) positioning said nozzle with its outlet from about 2.5 feet to about 5.4 feet above said collection surface.

11. The method of claim 7 which includes the steps of:

(a) selecting a nozzle configuration having an outlet of about 1.0 inch wide; and (b) positioning said nozzle with its outlet from about 2.9 feet to about 6.2 feet above said collection surface.

12. The method of claim 7 which includes the step of selecting a rectangular nozzle configuration having a width of from about 0.5 to about 4.0 inches wide and a length from about 5.0 to about 16.0 inches.

* * * * *

UNITED STATES PATENT AND TRADEMARK OFFICE

CERTIFICATE OF CORRECTION

PATENT NO. : 4,153,488
DATED : May 8, 1979
INVENTOR(S) : Donald E. Wiegand

It is certified that error appears in the above-identified patent and that said Letters Patent are hereby corrected as shown below:

Column 6, line 7: Insert --within-- after the word "range".

Column 14, line 4: Delete "in" and insert --is--.

Column 15, line 50: Delete "and".

Signed and Sealed this

*Twenty-third* Day of *June 1981*

[SEAL]

*Attest:*

RENE D. TEGTMEYER

*Attesting Officer*

*Acting Commissioner of Patents and Trademarks*